US007645551B2

(12) United States Patent
Sifain et al.

(10) Patent No.: US 7,645,551 B2
(45) **Date of Patent: *Jan. 12, 2010**

(54) TONER PROCESSES

(75) Inventors: Amgad W. Sifain, Hamlin, NY (US); Emily L. Moore, Mississauga (CA); Anthony Uttaro, Jr., Rochester, NY (US); Peter V. Nguyen, Webster, NY (US); Jon T. Owens, Spencerport, NY (US); Ryan Accetta, Rochester, NY (US); Karen A. Moffat, Brantford (CA); Vladislav Skorokhod, Mississauga (CA); Cuong Vong, Hamilton (CA); Wafa F. Bashir, Mississauga (CA); Richard P. N. Veregin, Mississauga (CA); Shigang S. Qiu, Etobicoke (CA)

(73) Assignee: Xerox Corporation, Norwalk, CT (US)

( * ) Notice: Subject to any disclaimer, the term of this patent is extended or adjusted under 35 U.S.C. 154(b) by 338 days.

This patent is subject to a terminal disclaimer.

(21) Appl. No.: 11/682,507

(22) Filed: Mar. 6, 2007

(65) Prior Publication Data

US 2008/0220359 A1 Sep. 11, 2008

(51) Int. Cl.
*G03G 9/08* (2006.01)

(52) U.S. Cl. ..... 430/109.1; 430/137.14

(58) Field of Classification Search ..... 430/109.1, 430/137.14

See application file for complete search history.

(56) References Cited

U.S. PATENT DOCUMENTS

| | | | | |
|---|---|---|---|---|
| 6,447,974 | B1 | 9/2002 | Chen et al. | |
| 2006/0121384 | A1 | 6/2006 | Patel et al. | |
| 2007/0141496 | A1* | 6/2007 | Vanbesien et al. | 430/108.8 |
| 2008/0166651 | A1* | 7/2008 | Vanbesien et al. | 430/109.3 |

OTHER PUBLICATIONS

U.S. Appl. No. 11/272,720, filed Nov. 15, 2005 to Patel.

* cited by examiner

*Primary Examiner*—John L Goodrow
(74) *Attorney, Agent, or Firm*—Oliff & Berridge, PLC

(57) ABSTRACT

Disclosed herein are toner particles generated by emulsion/aggregation processes. The processes are conducted under conditions that shorten the time for coalescence and post-formation washing, thereby increasing efficiency of the processes as compared to conventional processes.

17 Claims, No Drawings

TONER PROCESSES

BACKGROUND

Disclosed herein are emulsion/aggregation toner processes for making toner particles. The toner processes disclosed herein require less time to complete, while still maintaining all of the desired qualities necessary in toner particles.

REFERENCES

U.S. Publication No. 2006-0121384 to Patel, which is incorporated herein by reference in its entirety discloses toner compositions and processes, such as emulsion aggregation toner processes, for preparing toner compositions comprising a resin substantially free of crosslinking, a crosslinked resin, a wax and a colorant.

U.S. patent application Ser. No. 11/272,720 to Patel et al., which is incorporated herein by reference in its entirety, is directed to toner compositions and processes, such as emulsion aggregation toner processes, for preparing toner compositions comprising a high molecular weight non-crosslinked resin such as having a weight average molecular weight of at least 50,000, a wax, and a colorant.

Preparation of emulsion/aggregation (EA) toner particles are known in the art. Such processes typically include the aggregation of various toner components from a starting latex of the components, followed by the coalescence of the particles at elevated temperature. The components incorporated into the toner are chosen to provide all the necessary requirements for the final toner particle. A colorant may be added for color, a wax may be added to provide release from the fuser roll, and a binder resin may be designed to provide a low minimum fusing temperature (MFT). Another key toner property which may be controlled by the components of the EA toner particles is fused image gloss. This feature is particularly important when designing EA toners for providing low gloss or matte images.

It is still desired to improve processes of preparing of EA toner that may optimize tribocharging tunability, reduce the process time, and reduce the cost of preparing EA toner particles.

SUMMARY

In embodiments, disclosed is a process comprising forming a mixture of a gel latex, a high Tg latex, a wax and a colorant, aggregating toner particles in the mixture to form aggregated toner particles, coalescing the aggregated toner particles for from about 2 hours to about 4 hours to form coalesced toner particles, treating the coalesced toner particles with a pH treatment having a phi of from about 8.5 to about 10.5 at a temperature of from about 50° C. to about 75° C., and washing the coalesced toner particles to generate formed toner particles.

In further embodiments, disclosed is a toner composition having toner particles comprising a gel latex, a high Tg latex, a wax and a colorant, wherein the gel latex is present in an amount of from about 3 weight percent to about 30 weight percent of the toner particles, the high Tg, latex is present in an amount of from about 50 weight percent to about 95 weight percent of the toner particles, the wax is present in an amount of from about 2 weight percent to about 40 weight percent of the toner particles, and the colorant is present in an amount of from about 1 weight percent to about 25 weight percent of the toner particles, and wherein the process of making the toner particles includes forming a mixture of a gel latex, a high Tg latex, a wax and a colorant, aggregating toner particles in the mixture to form aggregated toner particles, coalescing the aggregated toner particles for from about 2 hours to about 4 hours to form coalesced toner particles, treating the coalesced toner particles with a pH treatment having a pH of from about 8.5 to about 10.5 at a temperature of from about 50° C. to about 75° C., and washing the coalesced toner particles from about 2 times to about 4 times to generate the toner particles.

In yet further embodiments, disclosed is a process comprising forming a mixture of a binder latex, a wax and a colorant, aggregating toner particles in the mixture to form aggregated toner particles, coalescing the aggregated toner particles for from about 2 hours to about 4 hours to form coalesced toner particles, treating the coalesced toner particles with a pH treatment having a pH of from about 8.5 to about 10.5 at a temperature of from about 50° C. to about 75° C., and washing the coalesced toner particles from about 2 times to about 4 times to generate formed toner particles.

EMBODIMENTS

The E/A toner disclosed herein includes at least one wax, at least one binder latex and at least one colorant.

Examples of waxes suitable for use herein include aliphatic waxes such as hydrocarbon waxes having about 1 carbon atom to about 30 carbon atoms, such as from about 1 carbon atom to about 30 carbon atoms or from about 1 carbon atom to about 25 carbon atoms, polyethylene, polypropylene or mixtures thereof.

More specific examples of waxes suitable for use herein include polypropylene and polyethylene waxes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. Commercially available polyethylenes possess, it is believed, a molecular weight (Mw) of about 1,000 to about 5,000, and commercially available polypropylenes are believed to possess a molecular weight of about 4,000 to about 10,000. Examples of functionalized waxes include amines, amides, for example AQUA SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, and POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson Wax.

In embodiments, the wax comprises a wax in the form of a dispersion comprising, for example, a wax having a particle diameter of from about 100 nanometers to about 500 nanometers, water, and an anionic surfactant. In embodiments, the wax is included in amounts such as from about 3 to about 40 weight percent. The latitude of the wax around about the centerline toner particle formulation may be about 11 weight percent±about 1 weight percent. In embodiments, the wax comprises polyethylene wax particles, such as POLYWAX 850, POLYWAX 750 and POLYWAX 655, commercially available from Baker Petrolite, having a particle diameter in the range of about 100 to about 500 nanometers.

As used herein "centerline toner particle formulation" refers to the ideal formulation of the toner particles disclosed herein. The term "latitude" refers to the variation possible in the formulation while still achieving the features associated with the centerline toner particle formulation.

In embodiments, the at least one binder latex may be a high glass transition temperature (Tg) latex, a gel latex, or a combination of the high Tg latex and the gel latex.

For example, the high Tg latex comprises latex comprising monomers, such as styrene, butyl acrylate, and beta-carboxyethylacrylate (beta-CEA) monomers prepared, for example, by emulsion polymerization in the presence of an initiator, a chain transfer agent (CTA), and surfactant.

Instead of beta-CEA, the high Tg latex may include any carboxyl acid containing monomer, such as maleic acid, citraconic acid, itaconic acid, alkenyl succinic acid, fumaric acid, mesaconic acid, maleic-acid anhydride, citraconic anhydride, itaconic-acid anhydride, alkenyl succinic-acid anhydride, maleic-acid methyl half ester, maleic-acid ethyl half ester, maleic-acid butyl half ester, citraconic-acid methyl half ester, citraconic-acid ethyl half ester, citraconic-acid butyl half ester itaconic-acid methyl half ester, alkenyl succinic-acid methyl half ester, fumaric-acid methyl half ester, half ester of the partial saturation dibasic acid such as mesaconic acid methyl half ester, dimethyl maleic acid, the partial saturation dibasic acid ester such as dimethyl fumaric acid, acrylic acid, methacrylic acid, alpha like crotonic acid, cinnamon acid, beta-partial saturation acid, crotonic-acid anhydride, cinnamon acid anhydride, alkenyl malonic acid, a monomer which has an alkenyl glutaric acid, and alkenyl adipic acids.

In embodiments, the high Tg latex comprises styrene:butyl acrylate:beta-CEA wherein, for example, the high Tg latex monomers include from about 70 weight percent to about 90 weight percent styrene, from about 10 weight percent to about 30 weight percent butyl acrylate, and from about 0.05 weight percent to about 10 weight percent beta-CEA.

In embodiments, the toner comprises high Tg latex in an amount of from about 50 weight percent to about 95 weight percent of the total weight of the toner described herein, such as 65 weight percent to about 80 of the total weight of the toner described herein. The latitude loading of the high Tg latex around about the centerline particle formulation may be about 71 weight percent±about 4 weight percent.

The high Tg latex disclosed herein that is substantially free of crosslinking and has a crosslinked density less than about 0.1 percent, such as less than about 0.05. As used herein "crosslink density" refers to the mole fraction of monomer units that are crosslinking points. For example, in a system where 1 of every 20 molecules is a divinylbenzene and 19 of every 20 molecules is a styrene, only 1 of 20 molecules would crosslink. Thus, in such a system, the crosslinked density would be 0.05.

The onset Tg (glass transition temperature) of the high Tg latex may be from about 53° C. to about 70° C., such as from about 53° C. to about 67° C. or from about 53° C. to about 65° C., or such as about 59° C.

The weight average molecular weight (Mw) of the high Tg latex may be from about 20,000 to about 60,000, such as from about 30,000 to about 40,000, or about 35,000.

The gel latex suitable for use herein may be prepared from a high Tg latex, such as a latex comprising monomers of styrene, butyl acrylate, beta-CEA, divinylbenzene, a surfactant and an initiator. Instead of the beta-CEA, the gel latex may include a carboxyl acid containing monomer as described above. The gel latex may be prepared by emulsion polymerization.

In embodiments, the crosslinked density of the gel latex is from about 0.3 percent to about 40 percent, such as from about 0.3 percent to about 35 percent or from about 0.3 percent to about 30 percent crosslinked density.

In embodiments, the toner comprises gel latex in an amount of from about 3 weight percent to about 30 weight percent of the total weight of the toner described herein, such as 5 weight percent to about 15 of the total weight of the toner described herein. The latitude of the gel latex around about the centerline particle formulation may be about 10 weight percent±about 2 weight percent.

Other latexes suitable for preparing the high Tg latex and the gel latex include styrene acrylates, styrene methacrylates, butadienes, isoprene, acrylonitrile, acrylic acid, methacrylic acid, beta-carboxy ethyl acrylate, polyesters, known polymers such as poly(styrene-butadiene), polymethyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly)methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), polystyrene-butyl acrylate-methacrylic acid), poly(styrene-butyl acrylate-acrylonitrile), poly(styrene-butyl acrylate-acrylonitrile-acrylic acid), and the like. In embodiments, the resin or polymer is a styrene/butyl acrylate/beta-carboxyethylacrylate terpolymer.

An initiator suitable for use in producing both the gel latex and the high Tg latex may be, for example, sodium, potassium or ammonium persulfate and may be present in with both the crosslinking starting monomers and non-crosslinking starting monomers in the range of from about 0.1 weight percent to about 5 weight percent, such as from about 0.3 weight percent to about 4 weight percent or from about 0.5 weight percent to about 3 weight percent of an initiator based upon the total weight of the monomers. In embodiments, the surfactant may be present in the range of from about 0.3 weight percent to about 10 weight percent, such as from about 0.5 weight percent to about 8 weight, percent or from about 0.7 to about 5.0 weight percent of surfactant.

Both the gel latex and the high Tg latex may be produced by similar methods. However, in producing the high Tg latex, no divinylbenzene or similar crosslinking agent is used. Examples of crosslinking agents suitable for making the gel latex include divinylbenzene, divinylnaphthalene, ethylene glycol diacrylate, 1,3-butylene-glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene-glycol #400 diacrylate, dipropylene glycol diacrylate, and polyoxyethylene (2)-2,2-bis(4-hydroxyphenyl) propane diacrylate. The gel latex and high Tg latex may be made by any suitable method. One example of a suitable method is described below for illustration.

First, a surfactant solution is prepared by combining a surfactant with water. Surfactants suitable for use herein may be anionic, cationic or nonionic surfactants in effective amounts of, for example, from about 0.01 to about 15, or from about 0.01 to about 5 weight percent of the reaction mixture.

Anionic surfactants include sodium dodecylsulfate (SDS), sodium dodecylbenzene sulfonate, sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™, obtained from Kao, and the like.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, SANISOL B-50 available from Kao Corp., which consists primarily of benzyl dimethyl alkonium chloride, and the like.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL, CA-210™, IGEPAL CA-520™, IGEPAL CA-720™, IGEPAL CO-890™, IGEPAL CO-720™, IGEPAL CO-290™, IGEPAL CA-210™, ANTAROX 890™, ANTAROX 897™, and mixtures thereof.

In a separate container, an initiator solution is prepared. Examples of initiators for the preparation of the latex include water soluble initiators, such as ammonium and potassium persulfates in suitable amounts, such as from about 0.1 to about 8 weight percent, and more specifically, in the range of from about 0.2 to about 5 weight percent. The latex includes both the initial latex and the added delayed latex wherein the delayed latex refers, for example, to the latex portion which is added to the already preformed aggregates in the size range of about 4 to about 6.5 μm, as described below.

In yet another container, a monomer emulsion is prepared by mixing the monomer components of the latex, such as styrene, butyl acrylate, beta-CEA, optionally divinylbenzene if producing the gel latex, and surfactant. In one embodiment, the styrene, butyl acrylate, and/or beta-CEA are olefinic monomers.

Once the preparation of the monomer emulsion is complete, a small portion, for example, about 0.5 to about 5 percent of the emulsion, may be slowly fed into a reactor containing the surfactant solution. The initiator solution may be then slowly added into the reactor. After about 15 to about 45 minutes, the remainder of the emulsion is added into the reactor.

After about 1 to about 2 hours, but before all of the emulsion is added to the reactor, 1-dodecanethiol or carbon tetrabromide (chain transfer agents that control/limit the length of the polymer chains) is added to the emulsion. In embodiments, the charge transfer agent may be used in effective amounts of, for example, from about 0.05 weight percent to about 15 weight percent of the starting monomers, such as from about 0.1 weight percent to about 13 weight percent or from about 0.1 weight percent to about 10 weight percent of the starting monomers. The emulsion is continued to be added into the reactor.

The monomers may be polymerized under starve fed conditions as referred to in U.S. Pat. No. 6,447,974, incorporated by reference herein in its entirety, to provide latex resin particles having a diameter in the range of from about 20 nanometers to about 500 nanometers, such as from about 75 nanometers to about 400 nanometers or from about 100 to about 300 nanometers.

Colorants or pigments include pigments, dyes, mixtures of pigments and dyes, mixtures of pigments, mixtures of dyes, and the like. In embodiments, the colorant comprises a pigment, a dye, mixtures thereof, carbon black, magnetite, black, cyan, magenta, yellow, red, green, blue, brown, mixtures thereof, in an amount of about 1 weight percent to about 25 weight percent by weight based upon the total weight of the toner composition, such as from about 2 weight percent to about 20 weight percent or from about 5 weigh percent to about 15 weight percent based upon the total weight of the toner composition. In embodiments, the latitude of colorant around about a centerline particle formulation is about 8 weight percent±about 0.5 weight percent based upon the total weight of the toner composition. It is to be understood that other useful colorants will become readily apparent to one of skill in the art based on the present disclosure.

In general, useful colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanent Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Yellow GR, F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICO BLACK and cyan components may also be selected as pigments.

Known emulsion/aggregation toner processes may take up to as long as about 24 hours for the aggregation and coalescence stages to be completed. Once coalescence is complete, the toner particles are then washed for at least about 5 times in order to remove residual ions and surfactants from the toner particles. Such a wash procedure may add at least about another 20 hours to the toner preparation process.

Thus, it is desired to formulate a toner preparation process that requires less time to complete, while still maintaining all of the desired toner particles qualities. Previous attempts to shorten the length of time for the toner generating process to be complete have resulted in toner particles with inferior qualities, such as poor A-zone and C-zone charge performance, and poor relative humidity (RH) sensitivity. With the toner particle generating processes disclosed herein, it is possible to generate the toner particles in a process that allows for at least an about 25% reduction in cycle time for the aggregation and coalescence process, and at least about a 40% reduction in cycle time for the washing step, while maintaining suitable A-zone and C-zone charge performance.

An example of a suitable process for generating toner particles includes forming a mixture of the binder latex, optionally with wax and, colorant, and deionized water in a vessel. The aggregation time may be shortened by using an emulsion having a lower solids content. For example, instead of a solids content of greater than about 14% of the emulsion as known in the art, the present method comprises a solids content of no greater than 14%, such as from about 12% to about 13.5% or about 13% solids content of the emulsion prior to aggregation.

The mixture is then stirred using a homogenizer until homogenized and then transferred to a reactor where the homogenized mixture is heated to a temperature of, for example, about 50° C. and held at such temperature for a period of time to permit aggregation of toner particles to the desired size.

Once the desired size of aggregated toner particles is achieved, further aggregation is halted. This may be done in any suitable manner, for example by adjusting the pH of the mixture in order to inhibit further toner aggregation.

The toner particles may then further be heated to a temperature of, for example, from about 90° C. to about 100° C. and the pH lowered with an acid in order to enable the particles to coalesce and spherodize. Examples of acids suitable for use in order to enable the toner particles to coalesce and spherodize include nitric acid.

In embodiments, the flocculates or aggregating agents may be used in an amount of from about 0.01 weight percent to about 10 weight percent of the toner composition, such as from about 0.02 weight percent to about 5 weight percent or from about 0.05 weight percent to about 2 weight percent. For example, the latitude of flocculates or aggregating agents around about a centerline particle formulation is about 0.17 weight percent±about 0.02 weight percent based upon the total weight of the toner composition.

Dilute solutions of flocculates or aggregating agents may be used to optimize particle aggregation time with as little fouling and coarse particle formation as possible. Examples of flocculates or aggregating agents may include polyaluminum chloride (PAC), dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ (available from Alkaril Chemical Company), SANIZOL™ (benzalkonium chloride) (available from Kao Chemicals), and the like, and mixtures thereof.

During particle coalescence, the particle shape may be monitored until the desired particle circularity as disclosed herein is achieved. Particle coalescence may be from about 2 hours to about 4 hours, such as from about 2.5 hours to about 3.5 hours or about 3 hours.

The particles are cooled and then undergo a pH treatment at a pH of from about 8.5 to about 11, such as from about 8.75 to about 10.75 or from about 9 to about 10.5, and at a temperature of from about 50° C., to about 75° C., such as from about 55° C. to about 70° C. or from about 57° C. to about 69° C. The pH treatment includes treatment of the toner particles with a base such as sodium hydroxide. This pH treatment is utilized to stabilize the particle and to regulate charging characteristics of the final toner particles.

The toner particles may then be washed from about 2 times to about 4 times, such as about 3 times, and then dried. The washing steps may involve a number of washing with water (for example, deionized water) only, or may involve a combination of washing with water and with an acid. For example, the toner particles may be washed first with water, the particles may then be washed a second time with an acid, such as nitric acid or those disclosed above, to lower the pH of the toner particle mixture to from about 3 to about 5, and the toner particles may then be washed a third and final time with water. After the final washing step, the toner particles are dried in order to evaporate the liquid of the toner particle mixture.

The size of the formed toner particles may be from about 3 μm to about 25 μm, such as a toner particle size of from about 3 μm to about 7 μm or from about 4 μm to about 12 μm.

The circularity may be determined using the known Malvern Sysmex Flow Particle Image Analyzer FPIA-2100. The circularity is a measure of the particles closeness to a perfect sphere. A circularity of 1.0 identifies a particle having the shape of a perfect circular sphere. The toner particles described herein may have a circularity of from about 0.9 to about 1.0, such as from about 0.93 to about 1.0 or from about 0.95 to about 1.0.

The developed toner mass per unit area (TMA) suitable for the printed images from the toner described herein may be in the range of from about 0.35 $mg/cm^2$ to about 0.55 $mg/cm^2$, such as from about 0.4 $mg/cm^2$ to 0.5 about $mg/cm^2$ or from about 0.43 $mg/cm^2$ to about 0.47 $mg/cm^2$.

The onset Tg (glass transition temperature) of the toner particles may be from about 40° C. to about 65° C., such as from about 45° C. to about 60° C. or from about 50° C. to about 55° C.

The toner particles also may have a size such that the upper geometric standard deviation (GSDv) by volume for (D84/D50) is in the range of from about 1.15 to about 1.25, such as from about 1.18 to about 1.23. The particle diameters at which a cumulative percentage of 50% of the total toner particles are attained are defined as volume D50, which are from about 5.45 to about 5.88, such as from about 5.47 to about 5.85. The particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). The upper GSDv value for the toner particles indicates that the toner particles are made to have a very narrow particle size distribution.

It may also be desirable to control the toner particle size and limit the amount of both fine and coarse toner particles in the toner. The toner particles may have a very narrow particle size distribution with a lower number ratio geometric standard deviation (GSDn), which is expressed as (number D50/number D16), of from about 1.20 to about 1.30, such as from about 1.22 to about 1.29.

In embodiments, the desired charge distribution for the toner particles described herein in the C-zone charge is from about −4 mm to about −12 mm, such as from about −5 mm to about −11 mm or from about −6 nm to about −10 mm, and a charge distribution in the A-zone is from about −0.25 mm to about −7 mm, such as from about −0.5 to about −6 mm or from about −1 mm to about −4 mm.

The charge performance or distribution of a toner is frequently demarcated as q/d (mm). The toner charge (q/d) is measured as the midpoint of the toner charge distribution. The charge is reported in millimeters of displacement from the zero line in a charge spectrograph using an applied transverse electric field of 100 volts per cm. The q/d measure in mm displacement can be converted to a value in fC/μm by multiplying the value in mm by 0.092.

The toner particles disclosed herein may be suitable for use in a semi-conductive magnetic brush development system. In embodiments, a SCMB developer can be used in various systems, for example a hybrid jumping (HJD) system or a hybrid scavengeless development (HSD) system.

Embodiments described above will now be further illustrated by way of the following examples.

EXAMPLES

Each of Comparative Toner, Toner 1 and Toner 2 described below were derived from the same raw material and raw material amounts. Specifically, Comparative Toner, Toner 1 and Toner 2 all include (1) about 17.4 kg (about 70.5%) High Tg Latex of styrene butyl acrylate, made with a Tg onset of from about 57° C. to about 61° C., a molecular weight of from about 33,000 to about 37,000, particle size of from about 190 nm to about 250 nm at a solids content of from about 39 percent to about 43 percent, (2) about 4.0 kg (about 10.0%) Gel Latex—crosslinked, made at a particle size of from about 35 nm to about 55 nm, a Tg onset of from about 39° C. to about 43° C. at a solids content of from about 23 percent to about 2' percent, (3) about 5.04 kg (about 8.0%) carbon black dispersion—Regal 330 dispersed at about 17 percent solids, and (4) about 3.80 kg (about 11.5%) Polywax 655-Polywax 655 dispersed at about 31 percent solids. All of these raw materials were combined in a gallon vessel to form the toner particles described below.

Comparative Toner

The nominal toner protocol included adding the raw material described above to a solids concentration of about 14 percent, and undergoing a homogenization protocol to form uniform particles. The reactor was then heated up and aggregation was initiated. At about 14 percent solids this particle growth process would typically take from about 9 hours to about 11 hours. After the target size was achieved, the batch was heated to about 96° C. to allow the particles to begin to coalesce. At this time, the particle shape was controlled for a total of about 5 hours. The batch was then cooled to 63° C., where it is treated to a pH of about 10 and held for about 60 minutes. After the hold, the batch was cooled to 35° C. where it was discharged and sieved through a 20 μm screen. The slurry, at about 14 percent solids, was then filter pressed into a wetcake of from about 75 percent to about 80 percent solids, re-slurried in deionized water and then filter pressed again. This was completed a total of 5 times, with a known quantity of acid added at the fourth cycle for optimizing charging performance. After the 5th cycle, the cake was about 75 percent solids, and was then dried to a moisture content of less than about 0.7 percent.

Toner 1

The Toner protocol included adding the raw material constituents to a solids concentration of about 13 percent, and undergoing a homogenization protocol to form uniform particles. The reactor was then heated and aggregation was initiated. At about 13 percent solids, this particle growth process would typically take from about 6 hours to about 8 hours. After the target size as achieved, the batch was heated to 96° C. to allow the particles to begin to coalesce. At this time, the particle shape was controlled for a total of about 2.5 hours. The batch was then cooled to about 58° C. where it is treated to a pH of about 9 and held for about 60 minutes. After the hold the batch was cooled to 35° C., where it was discharged and sieved through a 20 μm screen. The slurry at about 13 percent solids, was then filter pressed into a wetcake of from about 75 percent to about 80 percent solids, re-slurried in deionized water and then filter pressed again. This was completed a total of 3 times, with a known quantity of acid added at the second cycle for optimizing charging performance. After the third cycle, the cake was at about 75 percent solids, and was then dried to a moisture content of less than about 0.7 percent.

Toner 2

The Toner 2 protocol included adding the raw material constituents to a solids concentration of about 14 percent, and undergoing a homogenization protocol to form uniform particles. The reactor was then heated, and aggregation was initiated. At about 14 percent solids, this particle growth process would typically take from about 9 hours to about 11 hours. After the target size was achieved, the batch was heated to about 96° C. to allow the particles to begin to coalesce. At this time, the particle shape was controlled for a total of about 5 hours. The batch was then cooled to about 68° C. where it was treated to a pH of about 10.5 and held for about 60 minutes. After the hold, the batch was cooled to about 35° C. where it was discharged and sieved through a 20 μm screen. The slurry at about 14 percent solids was then filter pressed into a wetcake of from about 75 percent to about 80 percent solids, re-slurried in deionized water and then filter pressed again. This was completed a total of 5 times, with a known quantity of acid added at the fourth cycle for optimizing charging performance. After the fifth cycle, the cake was about 75 percent solids, and was then dried to a moisture content of less than about 0.7 percent.

Table 1 below demonstrates the factors that were analyzed to provide an optimum design without adversely affecting toner characteristics.

TABLE 1

| | Design of Experiment | | |
|---|---|---|---|
| FACTORS | Nominal | TONER 1 | TONER 2 |
| Percent Solids | 14% | 13% | 14% |
| Coalescence Time | 5 hours | 2.5 hours | 5 hours |
| pH Treatment after coalescence | pH = 10 at 63° C. | pH = 9 at 58° C. | pH = 10.5 at 68° C. |
| Washing | 5 Washes | 3 Washes | 5 Washes |

From the statistical analysis for the design experiment set forth in Table 1, it was determined that (1) the best RH sensitivity occurred at 13% solids, 2.5 or 5 hour coalescence, a pH treatment at a pH of from about 9 to about 10 and a temperature of from about 58° C. to about 63° C., and three washes, (2) the best A-zone charge performance occurred at a pH treatment at a pH of from about 10 to about 10.5 and a temperature of from about 63° C. to about 68° C., and three washes, (3) the best C-zone charge performance occurred at a pH treatment at a pH of from about 10 to about 10.5 and a temperature of from about 63° C. to about 68° C., and three washes, and (4) the overall optimal design experiment was at 13% solids, 2.5 or 5 hour coalescence, a pH treatment at a pH of about 10 and a temperature of about 63° C., and 3 washes.

The overall optimum protocol was subsequently verified as demonstrated in Table 2 in order to define a center-line process.

TABLE 2

| RUN | PERCENT SOLIDS | COALESCENCE TIME (hours) | pH TREATMENT | pH HOLD TIME (minutes) | NUMBER OF WASHES | A-Zone q/d (mm) | C-Zone q/d (mm) |
|---|---|---|---|---|---|---|---|
| 1 | 13 | 2.5 | pH 10 at 63° C. | 20 | 5 | −1.3 | −7.3 |
| 2 | 14 | 5 | pH 10 at 63° C. | 20 | 5 | −2.2 | −7.2 |
| 3 | 13 | 2.5 | pH 10 at 63° C. | 20 | 3 | −2.0 | −7.0 |
| 4 | 14 | 5 | pH 10 at 63° C. | 60 | 3 | −2.5 | −6.5 |
| | | | | | 5 | −1.9 | −6.9 |
| 5 | 14 | 5 | pH 10 at 63° C. | 20 | 3 | −3.2 | −6.6 |

The toner characteristics of the toner particles generated by the shorter process as disclosed herein, unlike with toner particles generated by a longer process known in the art, were not affected and thus toner particles generated by a shorter more efficient process continue to demonstrate the high standard of image quality and machine performance necessary of toner particles.

Based on the above charging data, 3 wash process shows desirable lower C-zone and higher A-zone performance.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

forming a mixture of a gel latex, a high Tg latex, a wax and a colorant, aggregating toner particles in the mixture to form aggregated toner particles, coalescing the aggregated toner particles for from about 2 hours to about 4 hours to form coalesced toner particles, treating the coalesced toner particles with a pH treatment having a pH of from about 8.5 to about 10.5 at a temperature of from about 50° C. to about 75° C., and washing the coalesced toner particles to generate formed toner particles, wherein the gel latex is present in an amount of from about 3 weight percent to about 30 weight percent of the toner particles, the high Tg latex is present in an amount of from about 50 weight percent to about 95 weight percent of the toner particles, the wax is present in an amount of from about 2 weight percent to about 40 weight percent of the toner particles, and the colorant is present in an amount of from about 1 weight percent to about 25 weight percent of the toner particles.

2. The process according to claim 1, wherein the mixture has a solids content of from about 12 percent to about 13.5 percent of the mixture.

3. The process according to claim 2, wherein the solids content is about 13 percent of the mixture.

4. The process according to claim 1, wherein the pH treatment is at a pH of from about 9 to about 10.5.

5. The process according to claim 1, wherein the pH treatment is at the temperature of from about 55° C. to about 70° C.

6. The process according to claim 1, wherein the coalesced toner particles are washed from about 2 to about 4 times.

7. The process according to claim 1, wherein forming the mixture further includes mixing a flocculant with the gel latex, the high Tg latex, the wax and the colorant, wherein the flocculent is added in amounts of about 0.01 weight percent to about 10 weight percent of the toner particles.

8. The process according to claim 7, wherein a latitude of the flocculant around about a centerline particle formulation is about 0.17 weight percent± about 0.02 weight percent of the toner particles.

9. The process according to claim 1, wherein a latitude of the gel latex around about a centerline particle formulation is about 10 weight percent± about 2 weight percent, a latitude of the high Tg latex around about a centerline particle formulation is about 71 weight percent± about 4 weight percent, a latitude of the wax around about a centerline particle formulation is about 11 weight percent± about 1 weight percent, and a latitude of the colorant around about a centerline particle formulation is about 8 weight percent± about 0.5 weight percent.

10. The process according to claim 1, wherein a crosslinked density of the gel latex is from about 0.3 to about 40, and a crosslinked density of the high Tg latex is less than about 0.1.

11. A toner composition having toner particles comprising a gel latex, a high Tg latex, a wax and a colorant, wherein the gel latex is present in an amount of from about 3 weight percent to about 30 weight percent of the toner particles, the high Tg, latex is present in an amount of from about 50 weight percent to about 95 weight percent of the toner particles, the wax is present in an amount of from about 2 weight percent to about 40 weight percent of the toner particles, and the colorant is present in an amount of from about 1 weight percent to about 25 weight percent of the toner particles, and wherein the process of making the toner particles includes:

forming a mixture of a gel latex, a high Tg latex, a wax and a colorant, aggregating toner particles in the mixture to form aggregated toner particles, coalescing the aggregated toner particles to form coalesced toner particles, treating the coalesced toner particles with a pH treatment having a pH of from about 8.5 to about 10.5 at a temperature of from about 50° C. to about 75° C., and washing the coalesced toner particles from about 2 times to about 4 times to generate the toner particles.

12. The toner composition according to claim 11, wherein the mixture has a solids content of from about 12 percent to about 13.5 percent of the mixture.

13. The toner composition according to claim 12, wherein the solids content is about 13 percent of the mixture.

14. The toner composition according to claim 11, wherein the pH treatment is at a pH of from about 9 to about 10.5 and at the temperature of from about 55° C. to about 70° C.

15. The toner composition according to claim 11, wherein the coalesced toner particles are washed from about 2 to about 4 times.

16. The toner composition according to claim 11, wherein a latitude of the gel latex around about a centerline particle formulation is about 10 weight percent± about 2 weight percent, a latitude of the high Tg latex around about a centerline particle formulation is about 71 weight percent ± about 4 weight percent, a latitude of the wax around about a centerline particle formulation is about 11 weight percent± about 1 weight percent, and a latitude of the colorant around about a centerline particle formulation is about 8 weight percent± about 0.5 weight percent.

17. The toner composition according to claim 11, wherein a crosslinked density of the gel latex is from about 0.3 to about 40, and a crosslinked density of the high Tg latex is less than about 0.1.

* * * * *